US005439212A

United States Patent [19]

Hart

[11] Patent Number: 5,439,212

[45] Date of Patent: Aug. 8, 1995

[54] BALL PITCHING DEVICE

[75] Inventor: Dan Hart, 4900 Bell Rd., Auburn, Calif. 95602

[73] Assignee: Daniel L. Hart, Auburn, Calif.

[21] Appl. No.: 188,956

[22] Filed: Jan. 27, 1994

[51] Int. Cl.[6] ..... A63B 69/40

[52] U.S. Cl. ..... 273/26 D; 124/7

[58] Field of Search ..... 273/26 D, 55 R; 124/4, 124/6, 36, 7

[56] References Cited

U.S. PATENT DOCUMENTS

| | | | |
|---|---|---|---|
| 894,738 | 7/1908 | Hindmarsh | 124/7 |
| 1,152,186 | 8/1915 | Koehler . | |
| 1,162,910 | 12/1915 | Goude | 124/7 |
| 1,182,024 | 5/1916 | MacLeod | 124/7 |
| 1,257,625 | 8/1917 | Ferguson . | |
| 1,384,046 | 7/1921 | Carrion | 124/7 |
| 1,777,976 | 10/1930 | Lacoste | 273/26 D |
| 1,912,360 | 6/1933 | Blanchard | 124/7 |
| 2,080,958 | 5/1937 | Beasley et al. . | |
| 2,082,818 | 6/1937 | Atwell | 124/7 |
| 2,192,096 | 2/1940 | Minger | 124/7 |
| 2,834,331 | 5/1958 | Cowie | 124/7 |
| 3,254,639 | 6/1966 | Laird | 124/7 |
| 3,261,341 | 7/1966 | Laird | 124/7 |
| 3,277,878 | 10/1966 | Pankratz . | |
| 3,368,541 | 2/1968 | Brink | 124/7 |
| 3,406,674 | 10/1968 | Zone | 124/7 |
| 3,470,859 | 10/1969 | Ponza | 124/7 |
| 3,552,371 | 1/1971 | Kahelin | 124/7 |
| 3,722,494 | 3/1973 | Slevin | 273/26 D |
| 4,111,179 | 9/1978 | Hashimoto | 124/7 |
| 4,175,535 | 11/1979 | Diem | 124/7 |
| 4,423,717 | 1/1984 | Kahelin | 273/26 D |
| 4,860,717 | 8/1989 | Powell et al. . | |
| 5,123,643 | 6/1992 | Heilhecker et al. . | |

*Primary Examiner*—Theatrice Brown
*Attorney, Agent, or Firm*—Thomas M. Freiburger

[57] ABSTRACT

A ball throwing device for projecting a game ball, in particular for pitching a baseball or simulating the trajectory of a batted baseball, is manually operated and requires no electrical power. The device is also transportable in the manner of a hand truck and collapsible into a compact storage configuration. In a preferred embodiment, the pitching machine includes a frame with a base support for resting on the ground, a ball throwing arm pivotally supported on the frame for swinging motion, with a ball seat on the arm, and a latch on the frame for latching the throwing arm in a pre-throwing position until such time as the ball is to be released. A foot lever preferably is provided, pivoted from the frame, for receiving foot pressure and motion from a user. The foot motion loads a spring with a spring loading force which is transferred to the ball throwing arm, the arm remaining stationary when latched in the pre-throwing position. A linkage member connects the foot lever to the spring to load the spring and apply the spring loading force. In preferred embodiments the device includes a trajectory setting for adjusting the ball throwing arm so that the flight trajectory of the ball can be adjusted, from a hard pitch to a fly ball. Also, a height adjustment preferably is included, for adjusting the height of a thrown ball at a selected distance forward of the ball throwing device.

7 Claims, 6 Drawing Sheets

BALL PITCHING DEVICE

BACKGROUND OF THE INVENTION

The invention relates to sporting equipment, and more specifically the invention is concerned with a pitching machine, particularly for baseballs, which throws a ball to simulate either a pitched or a batted ball.

Ball throwing machines have been well known and have been produced in many different forms. For example, see the following U.S. patents, all of which relate to different types of ball throwing machines: U.S. Pat. Nos. 1,152,186 (Koehler), 1,237,625 (Fergusson), 2,080,958 (Beasley), 3,277,878 (Pankratz), 3,722,494 (Slevin), 3,760,787 (Kahelin), 4,860,717 (Powell) and 5,123,643 (Heilhecker).

An advertisement entitled "Hits Strike Zone Consistently", from *The Sporting Goods Dealer,* Feb. 1971, shows a baseball pitching machine having some features similar to those of the present invention. Advertised as a product of Trius Products, Inc. of Cleves, Ohio, the pitching machine is human-powered, requiring no electricity, and the advertisement states that the machine cannot be left cocked and accidentally tripped. Also, the machine is characterized as being capable of throwing strikes to batters or fly balls to fielders, through adjustments to an adjustable throwing arm. Little disclosure of structure is available from the advertisement, but it appears that the user loads a force into the machine with his foot, storing energy in a tension spring which is released when the ball is thrown by the machine.

The remaining references listed above show various types of ball throwing machine, most of them baseball pitching machines, and some of which use elastic bands or springs to store energy which is released when the ball is thrown.

Nothing in the prior art disclosed a pitching machine having the features of the present invention described below, including the type of energy storage, the range of adjustability of throwing force, trajectory and height of a pitched ball, the foldable/collapsibility of the machine and the easy portability of the machine.

SUMMARY OF THE INVENTION

The invention described herein combines several features of portability, easy storage, full adjustability of the character of the throw or pitch and relative simplicity of construction, to provide a ball throwing machine of optimum features and utility. The ball throwing machine has a frame with a series of pivot points which provide for fold-up collapsibility of the machine. A pair of wheels mounted near the bottom of the frame enable it to be transported in the manner of a hand truck when tipped forward. The frame includes an upright section and a base support section secured to the upright section by pivot joints and braces. On the upright portion of the frame is mounted a ball throwing arm which pivots forward when released to fling a ball in the forward direction. Power is supplied by a spring which is loaded by the user's stepping down on a foot lever. As the foot lever is pushed down, force is stored in the spring, tending to pull the ball throwing arm toward the throwing position, but merely storing tension in the machine as the arm is latched until the user is ready to fling the ball. At that point, the user pushes down on a hand lever and the ball throwing arm is released to throw the ball at the desired trajectory. Throwing force is adjustable via a turnbuckle or similar length adjustability device positioned in a linkage member extending from the foot lever. The shorter the linkage member is adjusted, the higher the foot lever when the throwing arm is in the latched position, and thus the greater the foot loading motion and resulting spring tension and stored energy to be used in flinging the ball.

The trajectory of the ball is adjustable via a mechanism which makes selectable the latched position of the ball throwing arm, to greater reclined positions or lesser reclined positions. At the maximum reclined setting of the ball throwing arm, in the latched position, the released spring force will throw the ball at a maximum height trajectory, simulating a high fly ball.

The pitched height of the ball, independent of the ball's trajectory, is also adjustable. This is accomplished in a preferred embodiment by a ball retaining cup on the ball throwing arm which can be tilted more or less forward. The more forward the tip or tilt of the ball cup, the lower will be the ball in the strike zone when throwing pitches, and vice versa. In a preferred embodiment the ball throwing cup is a generally cup shaped open cylinder with a closed bottom side. The open top is on an incline, and the ball throwing cup is rotatable about a fastener passing through the bottom of the cup, so that it can be turned to a position seating the ball on an incline tipped maximum rearward or maximum forward, or any setting between those limits. Although this preferred arrangement tips the ball seat toward the side in intermediate settings, this does not noticeably affect the character of the pitch.

In a preferred embodiment the spring used for storing the throwing force is a torsion bar. The ball throwing arm is fixed to one end of the torsion bar and a loading arm and the linkage member, leading to the foot lever, are near the other end of the torsion bar. Stepping down on the foot lever rotates one end of the torsion bar, storing a strong twisting spring force in the bar until the throwing arm is unlatched.

To provide the trajectory adjustment, the torsion bar is mounted on one horizontal axis which is supported from a rotatable shaft on a parallel horizontal axis, about one to two inches away. A trajectory adjustment lever or arm is secured to the shaft on this second horizontal axis, and when moved up or down, this rotates the shaft and swings the torsion bar in an arc centered on the shaft, in a forward or rearward arc of adjustment. The rearward arc of adjustment will recline the latched throwing arm more, providing for higher-trajectory throws.

A pair of wheels on the pitching machine are mounted on the forward side of the frame, near the bottom, similar to a hand truck. The pitching machine may easily be transported in the fully erected position, simply by tipping it forward and pulling on the frame. When the pitching device is collapsed to a compact configuration for transport and storage, it is still transportable as a hand truck.

It is therefore among the objects of this invention to greatly improve over previous baseball pitching machines or other ball throwing devices, with a fully hand-operated machine, requiring no power, which is stable in use but collapsible to a compact configuration, readily storable in the trunk of an automobile; and to provide a full range of pitching speeds, up to quite high speeds, with a wide range of adjustability of thrown ball trajectory as well as pitched height for a given trajectory. These and other objects, advantages and features of the invention will be apparent from the following description of a preferred embodiment, considered along with the accompanying drawings.

DESCRIPTION OF PREFERRED EMBODIMENTS

Figure 1:
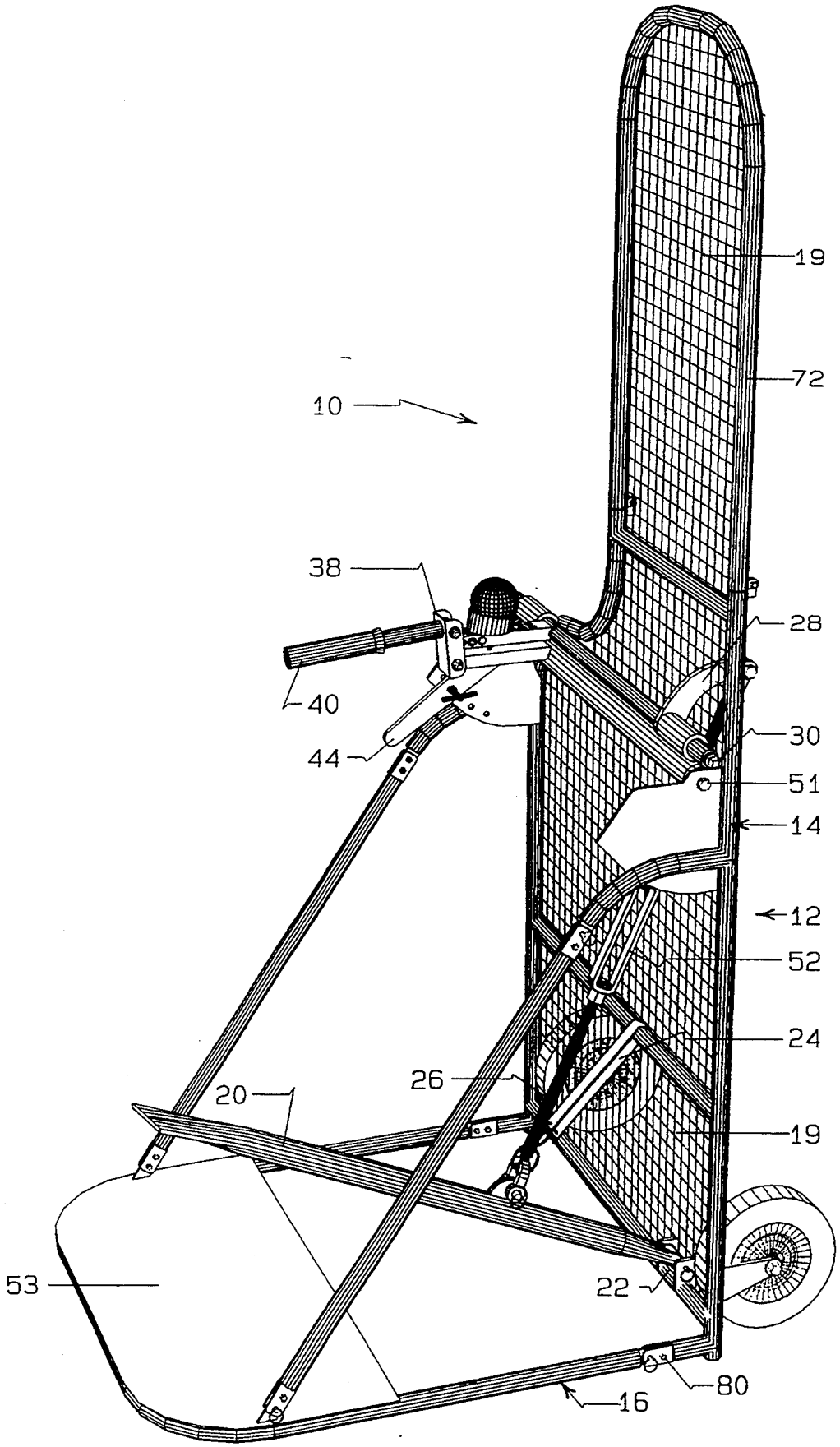
FIG. 1 is a perspective view showing a ball throwing device according to the invention, in fully erected configuration.

FIGS. 1–7 show a pitching machine or ball throwing device 10 according to the principles of the invention. As indicated in FIG. 1 and the other views, the ball throwing device includes a frame generally indicated at 12, including an upright portion 14 and a bottom support base or section 16, adapted to rest flatly on the ground or other horizontal surface. Provision can be made for hanging a bucket of balls on the frame, such as a hook (not shown) secured at an appropriate location on the frame. Safety netting 19 preferably is included on the frame, of wire or mesh fabric, such as nylon netting. The netting may be fastened onto the frame by hook and loop fasteners (Velcro), not shown.

Figure 2:
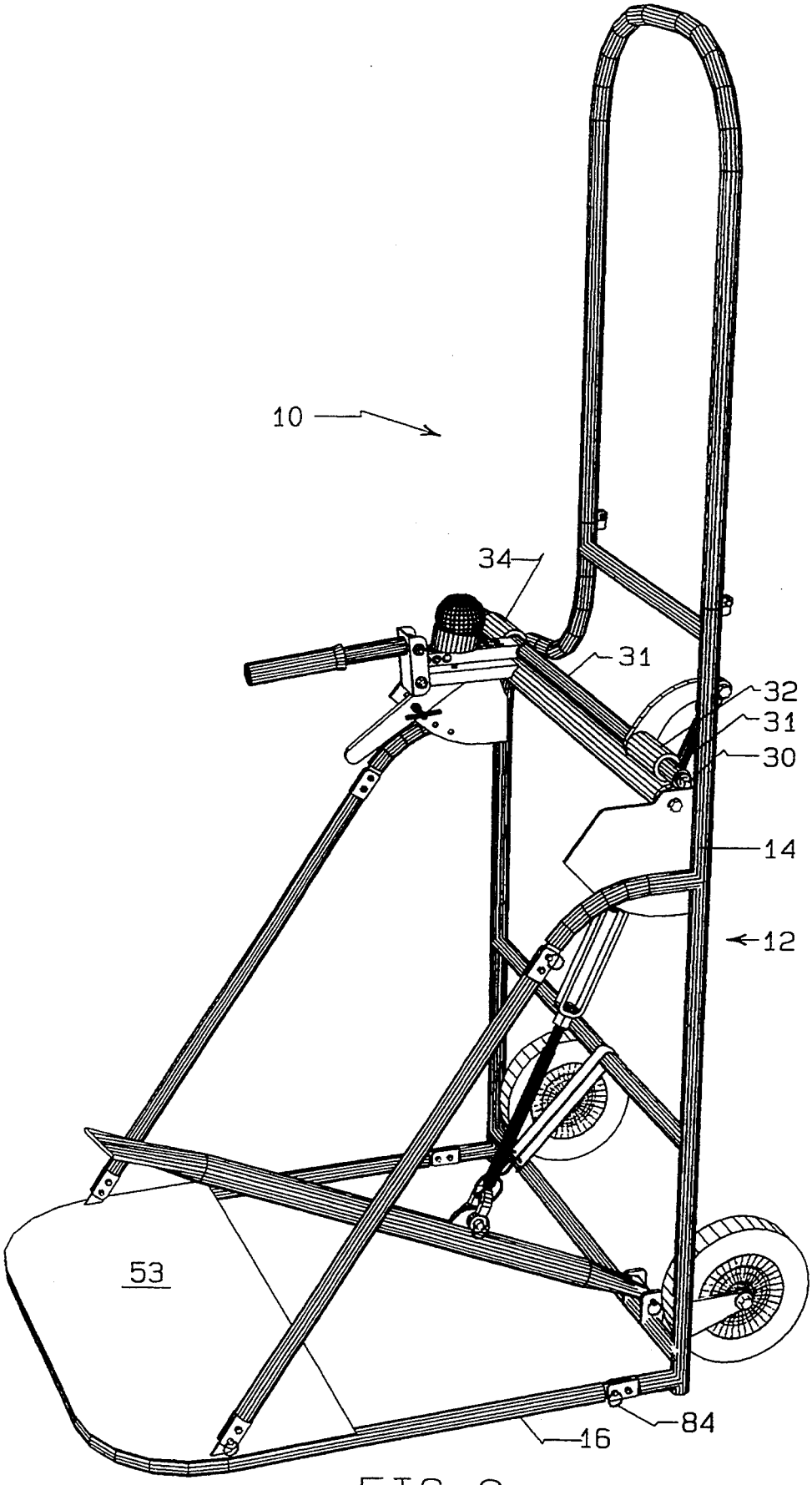
FIG. 2 is a view similar to FIG. 1 but with safety netting removed for clarity.
Figure 3:
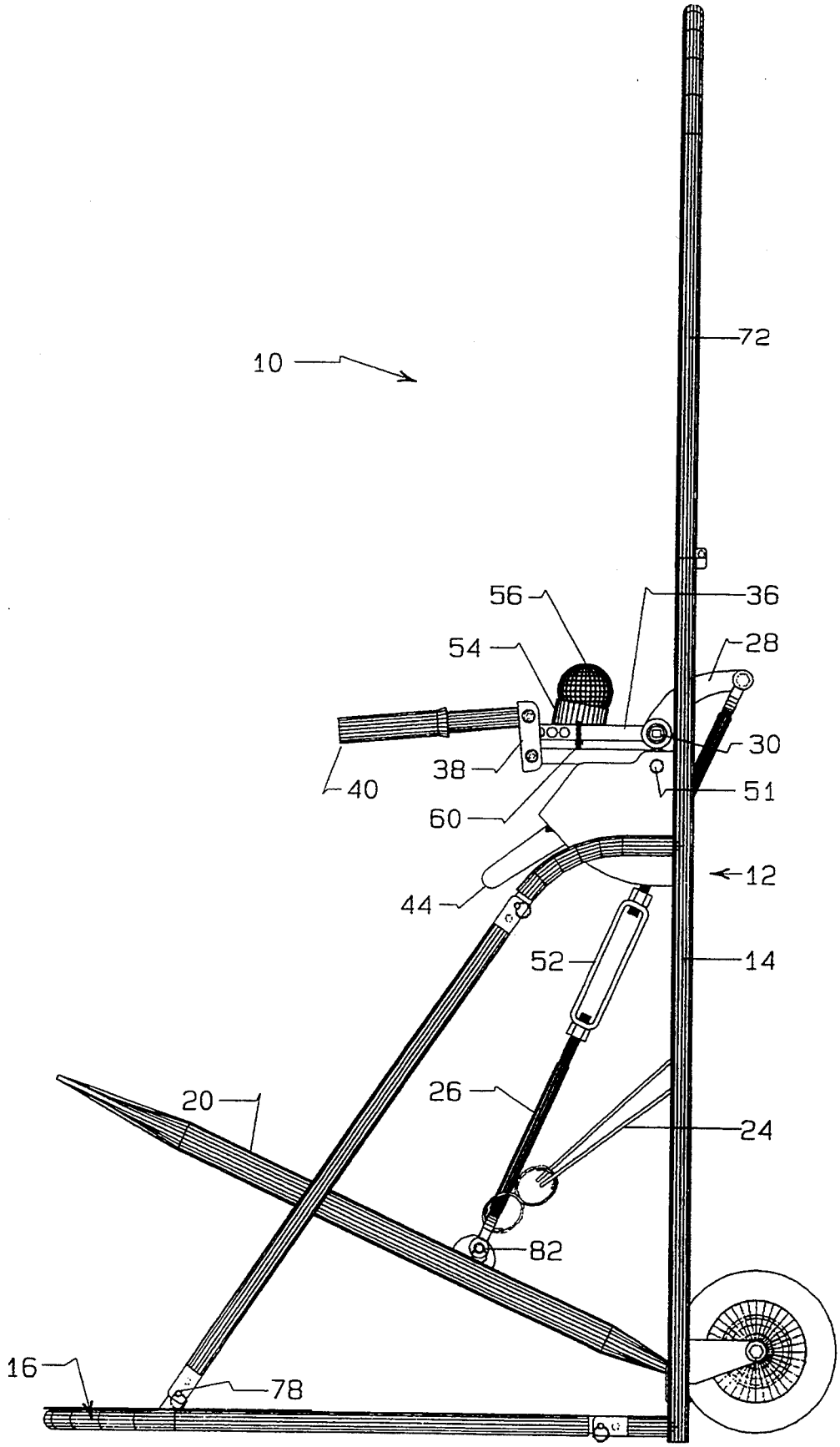
FIG. 3 is a side elevation view of the ball throwing device.

As shown in the drawings, a foot pedal or lever 20 is positioned to be operated by a user standing behind the pitching machine 10. The foot lever 20 is connected to the frame at a pivot connection 22, and is biased toward an unloaded position, elevated as shown in FIGS. 1 and 2, by a light tension spring or elastic tension member 24, referred to herein as a tension spring (see also FIGS. 3 and 4). The foot lever is attached by a linkage member 26, which may be a tension cable or a rod as shown, to a loading arm 28. In this preferred embodiment, the loading arm is secured to a torsion bar which stores the spring loading energy when the foot lever is pushed down. One end of the torsion bar 30 is visible in the drawings, as the end of a square steel bar. See also FIG. 5, showing the machine partially broken away and revealing the torsion bar. The torsion bar 30 may be contained within covering sleeve sections 31 for rotation in the sleeve sections. These sleeve sections, or the torsion bar directly, are journaled in bearing sleeves 32 and 34 at the right side and left side of the frame, respectively, as shown. At the left side, this end of the torsion bar does not rotate when the foot lever is pushed down, with the throwing mechanism latched, but rotates on release of the ball.

The left end of the torsion bar has affixed to it a ball throwing arm 36, extending rearwardly as shown. The ball throwing arm is latched by a manual latch device 38, with a handle 40 which is tripped down by the user when the ball is to be thrown. It can be seen from the drawings that the latch device latches over the end of the ball throwing arm and will remain in this position until forced to an unlatched position enabling the ball throwing arm to fling forward under the twisting spring force of the torsion bar.

The torsion bar 30 in this preferred embodiment is supported by a parallel rotatable shaft 42 to which are fixed the bearings 32 and 34. The shaft 42 is rotatable through an arc of adjustment, by manual angular movement of an adjustment arm 44 shown at the left side of this shaft. When the adjustment of 44 is swung up or down and locked to a new position, this changes the position of the torsion bar, swinging it forward or back within an arc whose center is the shaft 42. As explained above, this changes the angle of inclination of the ball throwing arm 36, to a more or less reclined latched position, ultimately affecting the trajectory of the thrown ball. As seen in the drawings (see particularly FIGS. 2 and 5), the adjustment arm can be locked by a screw fastener 46, a pin or other similar locking device in any one of a series of adjustment holes 48 in a bracket or plate 50 secured to the frame, which may also serve to support the shaft 42 for rotation. The shaft 42 may be a sleeve supported on a rod whose end is shown at 51 in FIGS. 1 and 3, for example.

The force and speed of the thrown ball can also be adjusted. As seen in the drawings, the linkage member 26 has a turnbuckle 52 or other link adjustability device, for adjusting the total arc through which the foot lever 20 is pushed upon loading of the machine. If the turnbuckle 52 is tightened, the linkage member 26 is shortened and the foot lever starts from a higher position, thereby affording a greater arc of loading and a higher tension in the spring. This higher spring tension results in a more forceful and faster-velocity release of the swinging ball throwing arm 36.

For stability of the machine 10 in foot loading and in release of the throwing arm, the bottom support base 16 of the frame 12 advantageously includes a foot platform 53, for placing one foot of the user on this platform while loading the foot lever with the other foot. Also, if desired the support base 16 can include several ground-penetrating spikes (not shown) extending downwardly for further stability.

Another adjustment feature of the ball throwing device 10 is embodied in a ball receiving seat 54, shown in the drawings as supporting a ball 56, such as a baseball or softball. The seat 54 may be comprised of an open-topped cup 54 which is generally cylindrical, with a closed bottom but a top rim 58 which is inclined relative to the bottom (see particularly FIGS. 3, 4 and 5). A fastener 60, such a bolt and nut, holds the cup-like ball seat to the ball throwing arm 36 in such a way as to be rotatable about the fastener. Rotation of the ball seat 54 so as to incline rearwardly will cause a pitched ball of a given trajectory to be higher at a given distance forward of the machine 10, i.e. it will have a higher position in or relative to the strike zone. On the other hand, rotation of the ball seat to incline forwardly to the maximum extent will put the ball at a lower point in the strike zone, with essentially the same trajectory. Intermediate positions rotation, although they will cause the ball seat rim to incline left or right, will not noticeably affect the flight of the ball left or right, but will adjust the ball height at the strike zone between the minimum and maximum.

As seen in the drawings, the frame 12 has a pair of wheels 70 mounted on the forward side of the frame, near the bottom. These enable the pitching machine, whether fully erected or collapsed, to be transported in the manner of a hand truck.

Figure 4:
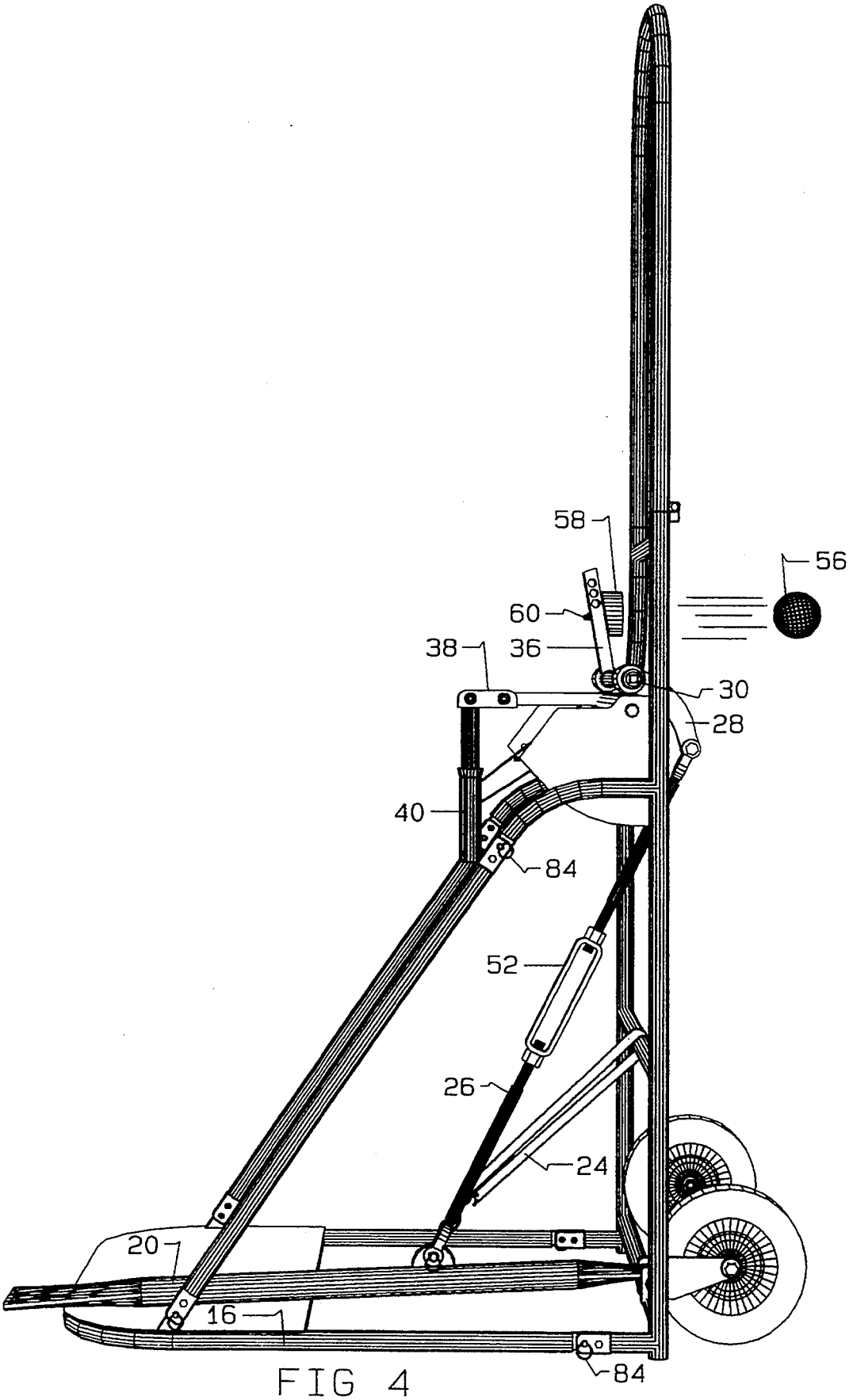
FIG. 4 is a side view in perspective showing the ball throwing device just after unlatching and release of the ball.
Figure 5:
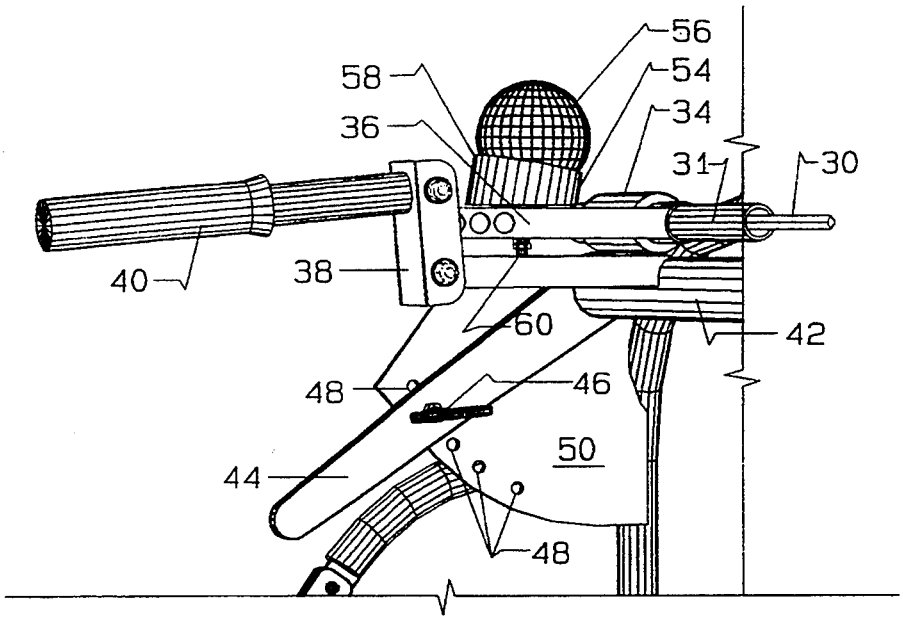
FIG. 5 is a detail view in perspective showing a ball throwing arm of the machine.

FIG. 4 shows the ball throwing assembly 10 just after release of the ball 56, shown being thrown in a relatively flat trajectory. In FIG. 4 the foot lever 20 is fully depressed down against the bottom support base 16, essentially down to the ground in the position which represents full spring loading just prior to release of the ball. The loading arm 28 has been pulled down, rotating that end of the torsion bar. The operator has just released the throwing arm latch 38 by pulling down on the handle 40 to unlatch the throwing arm as shown, and the spring tension force, i.e. the stored torsion bar force, has been released and the throwing arm 36 has swung upwardly to the point that the torsion bar has fully released its stored torsion energy.

It can be seen from FIG. 4 that the turnbuckle 52 (or other length adjustment device for the linkage member 26) will affect the fully loaded position of the loading arm 28 and of that end of the torsion bar, and will also affect the final released or rest position of the throwing arm 36 in pitching the ball. Thus, if the turnbuckle is tightened to shorten the linkage member 26, greater spring tension is loaded into the device and higher ball speed will be achieved, while at the same time the ball throwing arm 36 will travel through a slightly greater arc, to a more forward orientation at its released position such as shown in FIG. 4. For small adjustments of the turnbuckle, this has only a small effect on the trajectory of the ball. In some cases of larger adjustment, the operator may wish to make a trajectory adjustment using the adjustment arm 44, shifting the locking pin 46 to a different one of the setting holes 48.

In one specific embodiment the ball throwing device 10 of the invention is able to achieve a maximum ball speed of about 70 miles per hour, although greater speeds could be achieved with changes in structure, including the spring loading arrangement. This preferred embodiment employs a torsion bar of heat treated steel, square stock, $\frac{3}{8}$ inch width, with $29\frac{1}{8}$ inches length of torsion bar between the ball throwing arm and the point of attachment of the loading arm 28. To achieve the maximum speed the turnbuckle 52 is arranged such that pushing down the foot pedal rotates the right end of the torsion bar about 45 degrees from its rest position. In this embodiment the ball throwing arm 36 has a length or radius of about $4\frac{1}{4}$ inches from the center of the torsion bar to the center of the ball seat. Essentially this same maximum speed will be attained upon release of the ball with these settings, regardless of the trajectory adjustment of the ball throwing arm, although the ball speed upon reaching a batter will differ depending upon trajectory.

Figure 6:
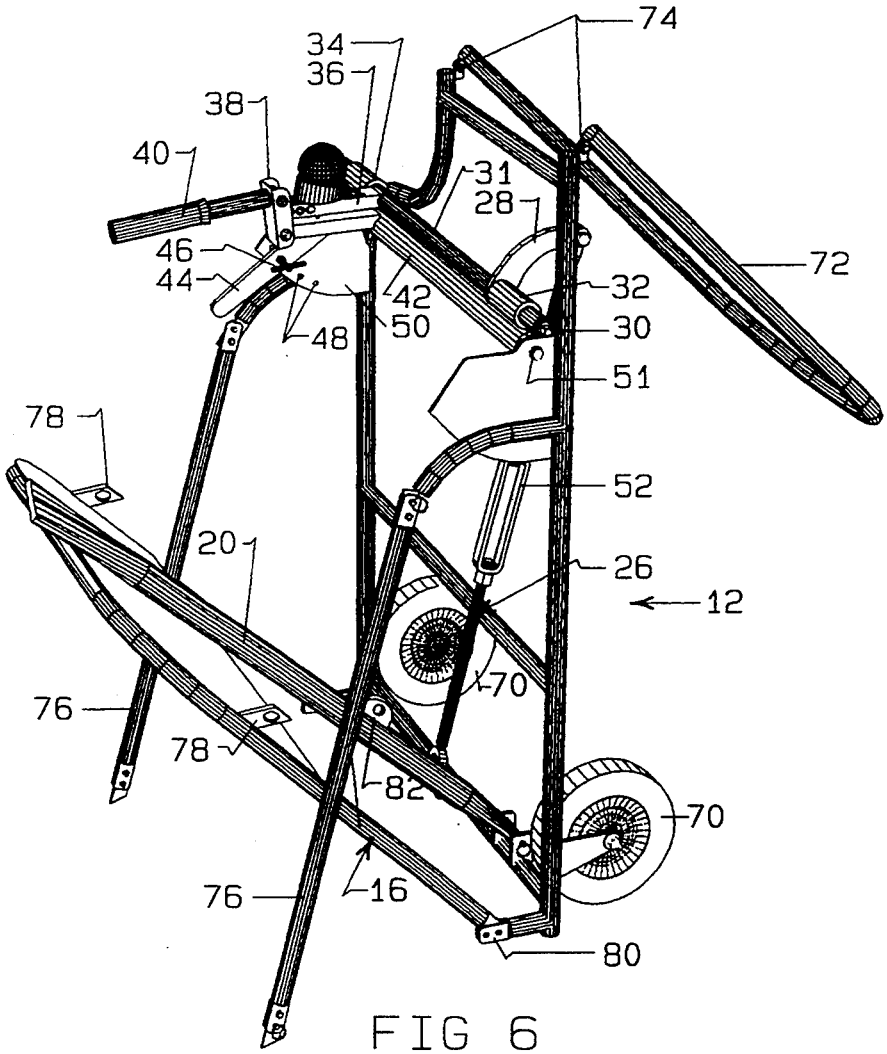
FIG. 6 is a perspective view showing the device partially folded toward the collapsed configuration.
Figure 7:
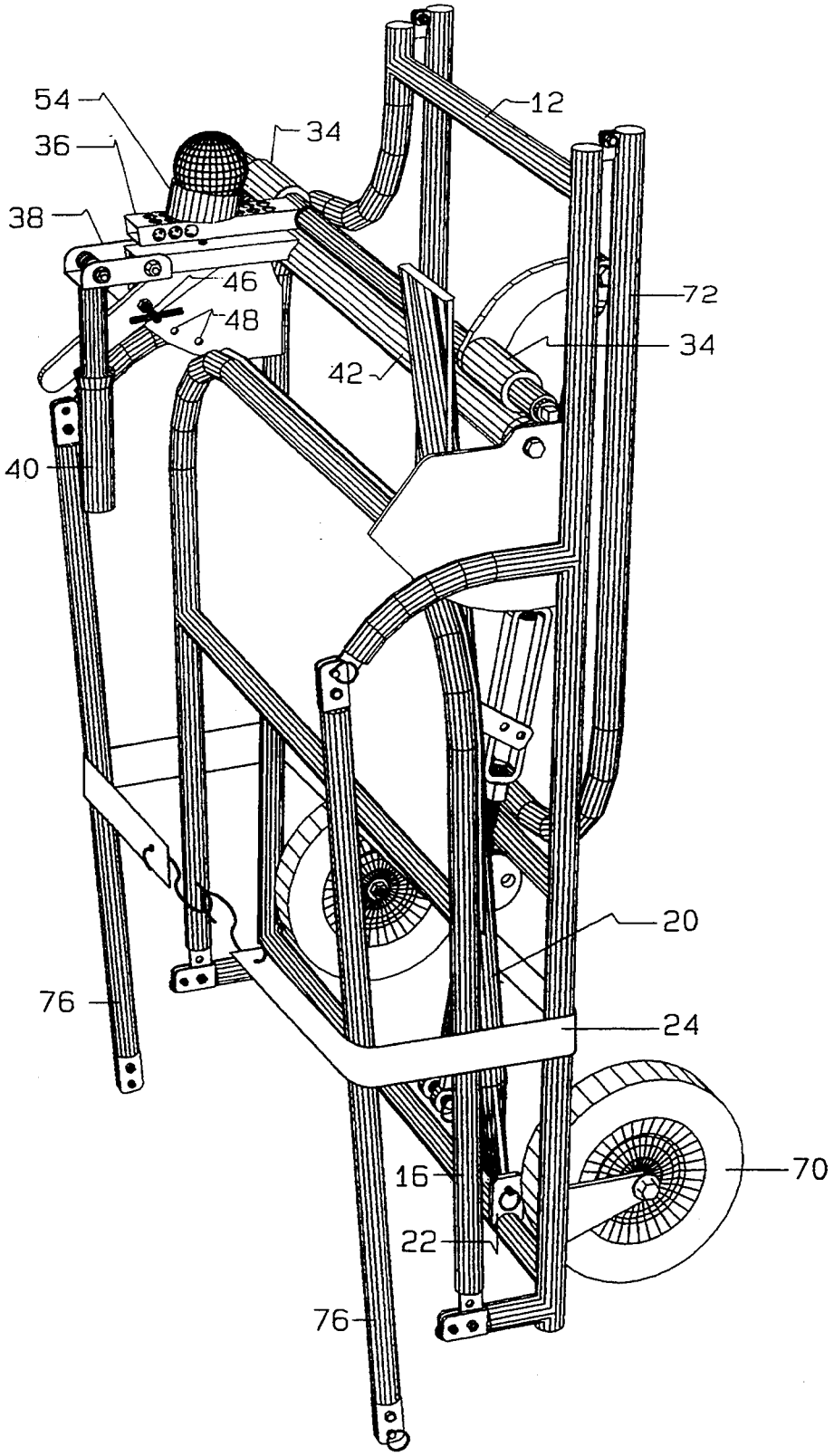
FIG. 7 is similar view, showing the device fully collapsed in the compact configuration for transport and storage.

FIGS. 6 and 7 illustrate the folding of the ball throwing machine 10 to a compact configuration for storage and transport. FIG. 6 shows the frame 12 with a top frame portion 72 partially folded forwardly/downwardly about pivot connections 74. Also, a pair of struts 76 have been disengaged from the bottom support base 16, from pin connections 78, and the bottom support base is shown pivoted partially upward, about pivot connections 80. The foot lever 20 is also shown pivoted partway upwardly, having been released at a pin connection 82 from the linkage member 26. The light tension spring or rubbery tension member 24 has also been released from the foot lever and disconnected and is not shown in FIG. 6.

The pivot connections of the frame such as at 80 can be of a type which is capable of locking in position after opening of the frame. Thus, ring-ended pins 84 are shown in the drawings as an example (see FIGS. 2 and 4).

FIG. 7 shows the assembly fully collapsed and ready to be transported similarly to a hand truck, by tilting the assembly forward and using the wheels 70. As shown in the figure, the top frame portion 72 has been fully folded down against the front side of the frame, the bottom support base 16 has been fully folded upwardly from the other side and the struts 76 hang vertically at the back side of the collapsed assembly. The tension spring or elastic band 24, used as a tension member in operation of the device (FIGS. 1, 3 and 4) can be used to wrap around the collapsed assembly, to hold the struts 76 back against the remainder of the assembly and also to hold the top frame portion 72 in the collapsed position as shown in FIG. 7. FIG. 7 also shows the foot lever 20, pivoted up via the pivot connection 22 and stored essentially in an upright position, between the upright portion 12 of the frame and the folded-up bottom support base 16.

The above described preferred embodiments are intended to illustrate the principles of the invention but without limiting its scope. Other embodiments and variations to these preferred embodiments will be apparent to those skilled in the art and may be made without departing from the essence and scope of the invention as defined in the claims.

I claim:

1. A ball throwing device for projecting a game ball at a selectable speed and trajectory, comprising:

a frame with support means for positioning the frame stably on the ground or other surface, a ball throwing arm having ball seat means near one end for receiving and holding a ball during throwing, with pivotal arm support means for pivotally mounting the throwing arm on the frame for swinging motion relative to the frame, latch means connected to the frame for latching the ball throwing arm in a pre-throwing position and for enabling manual release of the throwing arm, foot lever means secured to the frame for receiving foot pressure and motion from a user effective to move the foot lever means from an unloaded to a loaded position, spring means connected to the ball throwing arm for applying a spring loading force to the throwing arm, urging the arm toward a ball throwing direction, when the throwing arm is latched in the pre-throwing position by the latch means, and linkage means connecting the foot lever means to the spring means so as to effect loading of the spring means to apply said spring loading force when the foot lever means is moved from the unloaded to the loaded position, trajectory setting means for adjusting the trajectory at which the ball is thrown by the ball throwing arm, comprising means for adjusting the angular position of the ball-throwing arm in its pre-throwing position from more backwardly reclined to less backwardly reclined, whereby the ball when released is thrown at a higher trajectory or a lower trajectory, respectively, and the frame including means for collapsing the frame from an erected configuration to a compact storage configuration, said means for adjusting the angular position of said ball throwing arm comprising a first horizontal shaft mounted for rotation on the frame, a second horizontal shaft in radially spaced, parallel relationship to the first horizontal shaft, bearing means fixed to the first horizontal shaft for supporting the second horizontal shaft, the ball-throwing arm being secured to the second horizontal shaft for rotation therewith, and adjustment lever means secured to the first horizontal shaft for rotatably adjusting the first horizontal shaft to thereby swing the second horizontal shaft through an adjustment arc whose center is the first horizontal shaft, thereby changing the angle of recline of the ball-throwing arm to affect the trajectory of the ball when thrown.

2. A ball throwing device according to claim 1, wherein the ball throwing arm further includes means for adjusting the ball seat means to adjust the height assumed by the thrown ball at a given distance forward of the ball throwing device.

3. A ball throwing device according to claim 1, including means for setting the adjustment lever means in any of at least three different angular positions.

4. A ball throwing device according to claim 1, wherein the second horizontal shaft comprises a torsion bar, with said ball throwing are secured near one end of the torsion bar and said linkage means secured near an opposite end of the torsion bar, the torsion bar being capable of accepting a twisting load between its ends as said spring loading force, and serving as said spring means.

5. A ball throwing device for projecting a game ball at a selectable speed and trajectory, comprising:

a frame with support means for positioning the frame stably on the ground or other surface, a ball throwing arm having ball seat means near one end for receiving and holding a ball during throwing, with pivotal arm support means for pivotally mounting the throwing arm on the frame for swinging motion relative to the frame, latch means connected to the frame for latching the ball throwing arm in a pre-throwing position and for enabling manual release of the throwing arm, foot lever means secured to the frame for receiving foot pressure and motion from a user effective to move the foot lever means from an unloaded to a loaded position, spring means connected to the ball throwing arm for applying a spring loading force to the throwing arm, urging the arm toward a ball throwing direction, when the throwing arm is latched in the pre-throwing position by the latch means, and linkage means connecting the foot lever means to the spring means so as to effect loading of the spring means to apply said spring loading force when the foot lever means is moved from the unloaded to the loaded position, and trajectory setting means for adjusting the trajectory at which the ball is thrown by the ball throwing arm, the trajectory setting means comprising means for adjusting the angular position of the ball-throwing arm in its pre-throwing position, from more backwardly reclined to less backwardly reclined, whereby the ball when released is thrown at a higher trajectory or a lower trajectory, respectively, said trajectory setting means comprising a first horizontal shaft mounted for rotation on the frame, a second horizontal shaft in radially spaced, parallel relationship to the first horizontal shaft, bearing means fixed to the first horizontal shaft for supporting the second horizontal shaft, the ball-throwing arm being secured to the second horizontal shaft for rotation therewith, and adjustment lever means secured to the first horizontal shaft for rotatably adjusting the first horizontal shaft to thereby swing the second horizontal shaft through an adjustment arc whose center is the first horizontal shaft, thereby changing the angle of recline of the ball-throwing arm to affect the trajectory of the ball when thrown.

6. A ball throwing device according to claim 5, including means for setting the adjustment lever means in any of at least three different angular positions.

7. A ball throwing device according to claim 5, wherein the second horizontal shaft comprises a torsion bar, with said ball throwing arm secured near one end of the torsion bar and said linkage means secured near an opposite end of the torsion bar, the torsion bar being capable of accepting a twisting load between its ends as said spring loading force, and serving as said spring means.

* * * * *